US007353668B2

(12) United States Patent
Ikoma

(10) Patent No.: US 7,353,668 B2
(45) Date of Patent: Apr. 8, 2008

(54) YARN FEEDER OF YARN FEEDING DEVICE FOR WEFT KNITTING MACHINE

(75) Inventor: Kenji Ikoma, Wakayama (JP)

(73) Assignee: Shima Seiki Mfg. Ltd., Wakayama (JP)

( * ) Notice: Subject to any disclaimer, the term of this patent is extended or adjusted under 35 U.S.C. 154(b) by 0 days.

(21) Appl. No.: 11/630,517

(22) PCT Filed: Jun. 14, 2005

(86) PCT No.: PCT/JP2005/010852

§ 371 (c)(1),
(2), (4) Date: Dec. 21, 2006

(87) PCT Pub. No.: WO2006/006336

PCT Pub. Date: Jan. 19, 2006

(65) Prior Publication Data

US 2008/0022727 A1 Jan. 31, 2008

(30) Foreign Application Priority Data

Jul. 7, 2004 (JP) ..... 2004-200780

(51) Int. Cl.
*D04B 15/52* (2006.01)

(52) U.S. Cl. ..... 66/127

(58) Field of Classification Search ..... 66/125 R, 66/126 R, 127, 128, 129
See application file for complete search history.

(56) References Cited

U.S. PATENT DOCUMENTS 5,345,789 A * 9/1994 Yabuta ..... 66/126 A
6,021,651 A * 2/2000 Shima ..... 66/126 A
6,647,749 B2 * 11/2003 Ikoma ..... 66/126 A
6,981,393 B2 * 1/2006 Ikoma ..... 66/126 A
6,988,385 B2 * 1/2006 Miyamoto ..... 66/127
7,201,023 B2 * 4/2007 Okuno et al. ..... 66/126 R
7,272,959 B2 * 9/2007 Morita et al. ..... 66/127
2004/0159126 A1 8/2004 Ikoma
2004/0211224 A1 10/2004 Miyamoto

FOREIGN PATENT DOCUMENTS

| | | |
|---|---|---|
| GB | 2137234 | 10/1984 |
| JP | 61-051061 | 11/1986 |
| JP | 4-33902 | 6/1992 |
| WO | 02/079556 | 10/2002 |
| WO | 03/010378 | 2/2003 |

* cited by examiner

*Primary Examiner*—Danny Worrell
(74) *Attorney, Agent, or Firm*—Wenderoth, Lind & Ponack, L.L.P.

(57) ABSTRACT

[PROBLEMS] To provide a yarn feeder in the yarn feeding device of a weft knitting machine in which a fabric having uniform stitches can be produced with high productivity without increasing the size of the yarn feeder. [MEANS FOR SOLVING PROBLEMS] In a switching mechanism arranged to switch a yarn feeder from feeding position to standby position while interlocking with selection release operation of a hauling means after feeding the yarn by setting the oscillating direction to the standby position of the yarn feeder after feeding the yarn, a neutral position holding means operated to be interlocked with the hauling means to hold the neutral position of the yarn feeder in a vertical altitude raised above the yarn feeding position is provided.

2 Claims, 12 Drawing Sheets

YARN FEEDER OF YARN FEEDING DEVICE FOR WEFT KNITTING MACHINE

DESCRIPTION

1. Technical Field

The present invention relates to a yarn feeder of a yarn feeding device for a weft knitting machine, in which a yarn feeding port of the yarn feeder put on standby at an end of the knitting fabric or at a changed portion of the knitting pattern, for example, an intarsia knitting pattern, can be switched over to a position outside the fabric knitting region.

2. Background Art

In general, a yarn feeder associated with a carriage to feed yarn to a needle of a needle bed for knitting the fabric is kept at a standby position outside the knitting region.

In this case, as the yarn feeder moves greater beyond the boundary with the adjoining knitting region, the position of the knitting yarn is lowered proportionately so that it becomes able to catch reliably the yarn in a hook of needle.

Meanwhile, in case of an intarsia knitting operation, such a yarn feeder is released from the entraining device at a position exceeding the boundary with the boundary with the adjacent knitting region.

In the aforementioned structure of the yarn feeding device, the yarn extending between the yarn feeder that has stopped inside the adjoining knitting region and the knitted fabric may obstruct the subsequent knitting operation in the next knitting region. Thus, there has been proposed by the inventor of the present invention such a yarn feeder of a weft knitting machine, comprising a switching mechanism for switch-swinging the position of the yarn feeding port installed in a feeder case, the switching mechanism further comprising a pressing operation part switch-operating the swinging direction and altitude of the yarn feeding port in association, wherein the said yarn feeder is capable of obtaining the same effect as in a case in which the amount of swinging of a yarn feeder is substantially increased without increasing the amount thereof (See Patent Document 1).

Patent Document 1: International Publication WO02-079556

DISCLOSURE OF INVENTION

In the aforementioned proposal of a yarn feeder provided by the inventor of the present invention, the yarn feeding port of the yarn feeder largely swings to the left or the right on its standby position so that the yarn drawn from the stitch at the end of the knitting region will be pulled up. Therefore, there was a fear that it might happened clogging of the stitch at the end of the knitting region and become very hard to form a uniform stitch therein.

The present invention has been proposed in consideration of the aforementioned problems. It is therefore an object of the present invention to provide a yarn feeder of a yarn feeding device used for a weft knitting machine, which is capable of producing a fabric having uniform stitches with high productivity without increasing the size of the yarn feeder.

In order to achieve the aforementioned object, a yarn feeder of a yarn feeding device used for a weft knitting machine according to the present invention, in which a plurality of yarn feeders which are engaged with an to be slide on knitting yarn guide rails arranged over a needle bed, an entraining means for entraining selectively any one of the yarn feeders and a switching mechanism for changing over the swing of a yarn feeding port provided at a lower end of a feeder rod between a yarn feeding position and a standby position interlocking with the operation of the entraining means, wherein before the selected yarn feeder through the operation of the entraining means having been entrained from a standby position to a yarn feeding position, the switching mechanism is operated so as to swing the yarn feeding port from the standby position to the yarn feeding position while, after having completed yarn feeding operation, the yarn feeding port being swung from one yarn feeding position to another standby position interlocking with the released selective operation of the entraining means, the yarn feeder being primarily characterized in that:

the switching mechanism comprises a selection lever pivoted to be enabled to swing, the selection lever being formed of two oblique surfaces each setting a swinging direction of the feeder rod and a receiving portion at an intermediate portion between the oblique surfaces for gripping the feeder rod at a neutral position in an upright position, and substantially formed in a T-like shape; and a neutral holding mechanism which comprises an operation device composed of a pair of links to be activated in association with the entraining means, is provided, wherein when the operation device being activated, portions adjacent to the middle of the selection lever are pushed up and swung by the pair of links respectively so that the receiving portion of the selection lever holds the upper end of the feeding rod upright state in the neutral position with making the upper end of the feeding rod confronted with the receiving portion of the selection lever.

Additionally, a yarn feeder of a yarn feeding device used for a weft knitting machine according to the present invention is characterized in that the switching mechanism includes a selection lever pivoted to be swung, the selection lever includes two oblique surfaces each setting a swinging direction of the feeder rod, and a receiving portion at an intermediate portion between the oblique surfaces for receiving the feeder rod at the neutral position in an upright state, and a neutral holding mechanism is formed by providing an operation member that operates the selection lever such that the receiving portion confronts an upper end of the feeder rod in the neutral position.

Further, a yarn feeder of a yarn feeding device for a weft knitting machine according to the present invention is characterized in that the operation member is formed of a pair of links that swing to move up a portion of the selection lever having a substantially T-like shape, which is adjacent to a side end of the selection lever. Further more, a yarn feeder according to the present invention is characterized in that the feeder rod forms a holding member that elastically holds a position set by one of the oblique surfaces and the receiving portion on the selection lever.

According to the present invention, since the switching mechanism comprises a selection lever pivoted to be enabled to swing, the selection lever being formed of two oblique surfaces each setting a swinging direction of the feeder rod and a receiving portion at an intermediate portion between the oblique surfaces for gripping the feeder rod at a neutral position in an upright position, and substantially formed in a T-like shape; and a neutral holding mechanism which comprises an operation device composed of a pair of links to be activated in association with the entraining means, is provided, wherein when the operation device being activated, portions adjacent to the middle of the selection lever are pushed up and swung by the pair of links respectively so that the receiving portion of the selection lever holds the upper end of the feeding rod upright state in the neutral position with making the upper end of the feeding rod confronted with the receiving portion of the selection lever, the yarn feeding port of the yarn feeder in the standby position is eliminated from greatly swinging horizontally as aforesaid proposals. Therefore, the knitting yarn extended from the stitch of the end of the knitting region in the knitted fabric can be prevented from receiving an oversized tension stress and clogging of stitch. In this way, it will advantageously lead to produce a knitted fabric having uniform stitches and high quality.

In the standby position, where the yarn feeder is kept upright state, the position of the yarn feeding port does not become higher. Therefore, this will advantageously allow the knitting yarn upon transfer of stitch or increase in the stitch at the end of the knitting region to reach the back surface of the needle.

Moreover, unlike a conventionally employed case, the yarn feeder does not have to be greatly slid out of the knitting region, it can be given advantageous improvement of the productivity by reducing the sliding distance of the yarn feeder.

Additionally, the switching mechanism is provided with the neutral position holding mechanism for holding the yarn feeding port at a low neutral position adjacent to the needle in the standby state of the yarn feeder. This will provide advantages for preventing the increase in size of the yarn feeder, resulting in the compact structure.

BEST MODE FOR CARRYING OUT THE INVENTION

Figure 1:
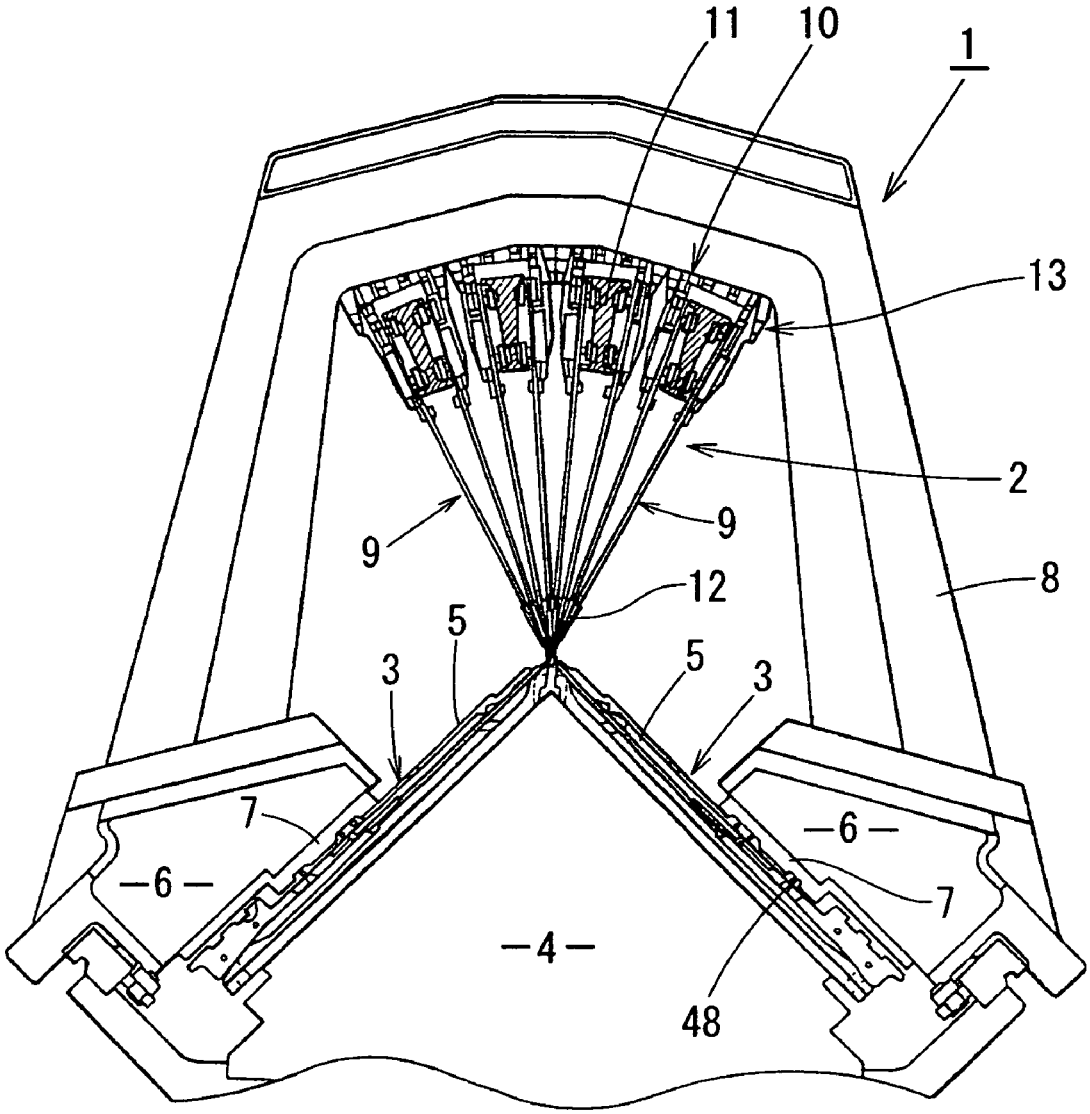
FIG. 1 is a side view in elevation of a weft knitting machine equipped with a yarn feed device including a yarn feeder according to the present invention.

An embodiment of a yarn feeding device for a weft knitting machine according to the present invention will be described referring to the drawings.

FIG. 1 is a lateral view of a weft knitting machine having a yarn feeding device including yarn feeders of the present invention, wherein a reference numeral 1 denotes the weft knitting machine in its entirety, and 2 denotes the yarn feeding device.

The weft knitting machine 1 has a pair of front and rear needle beds 3 disposed on a frame 4 in a fan shape with extreme ends thereof confronting each other, and each needle bed 3 has a plurality of knitting needles 5 thereon in parallel with each other so that they are movable back and force.

A carriage 6 is disposed on an upper surface of each needle bed 3 so that it can be caused to reciprocate by a belt drive device (not shown). A bat 48 of each knitting needle 5 is operated by a knitting cam 7 attached to the carriage 6 as shown in the drawing so as to be advanced and retracted.

A gate arm (slide drive mechanism) 8 is mounted on the carriages 6 so as to stride over the front and back needle beds 3, and is integrally coupled with the carriages 6. Mounted on the gate arm 8 are a entraining device 10 that brings yarn feeders 9, and a push-down member 13 that pushes down yarn feeding ports 12 of the yarn feeders 9 to positions adjacent to each extreme end of the knitting needles 5 and 5.

Four knitting yarn guide rails 11 are elongated longitudinally over the needle beds 3 and arranged backward and forward over there in the form of a fan at the position in the radical direction apart from the center nearly close to the extreme one end of the knitting needles 5 disposed in parallel with each other on the needle beds 3.

Figure 2:
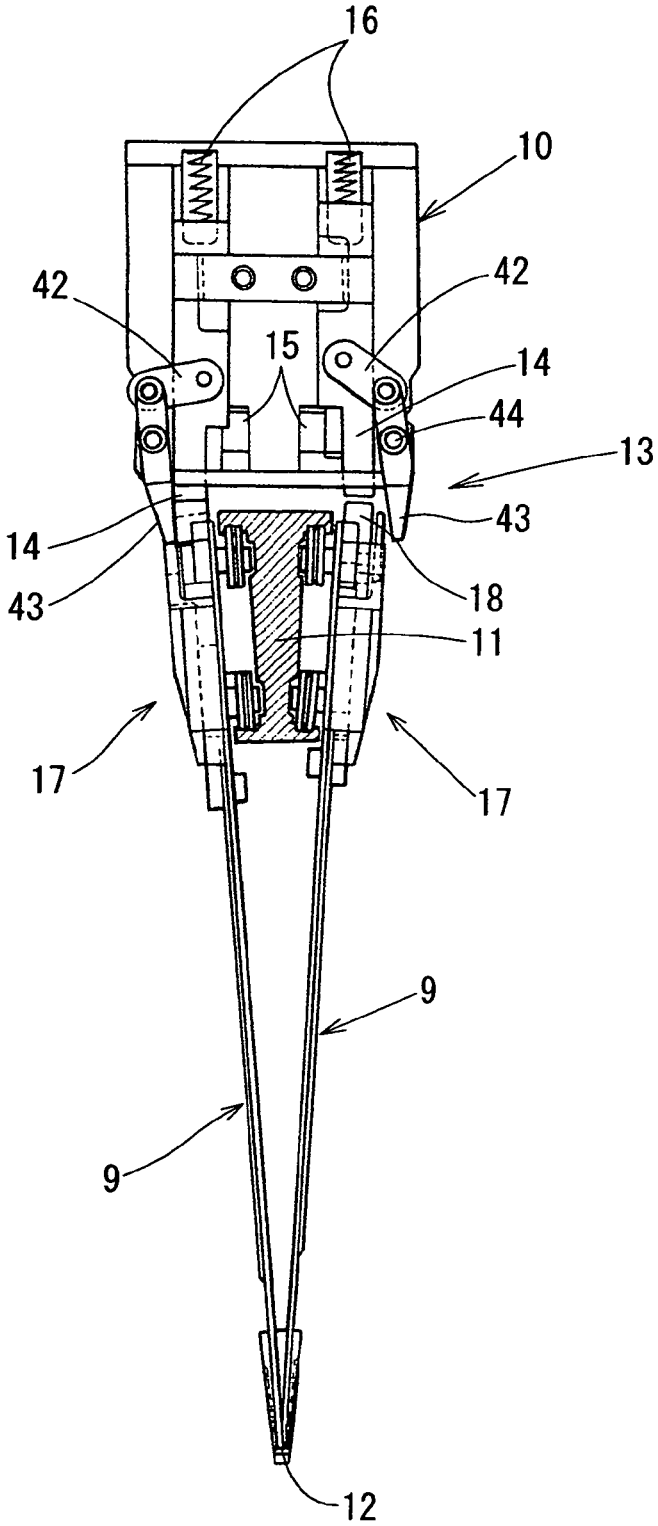
FIG. 2 is an enlarged view of the yarn feeder according to the present invention.

The entraining device 10 includes transmission rods 15 for transmitting movement of output shafts of solenoids, which are projected and retracted in response to a signal output from a controller (not shown), to entraining pins 14 as shown in FIG. 2. The entraining pins 14 are forced downward by means of springs 16 engaged into engagement portions 19 which are formed on a pair of right and left swinging pieces 18 disposed on a feeder case 17 of the respective yarn feeders 9 at portions adjacent to center of upper ends thereof. In this way, the yarn feeders 9 are fed by the entraining pins 14 (see FIG. 3).

The yarn feeder 9 is composed of a feeder case 17 supported by the knitting yarn guide rail 11 to be able to slide thereon, a feeder rod 20 provided with the yarn feeding port 12 at its lower end and suspended from the lower end portion of the feeder case 17, and a neutral position holding mechanism that hangs a feeder rod guide 21 for guiding the feeder rod 20 and holds the yarn feeding ports 12 in a neutral state at the standby position. An upper pivot portion of the feeder rod guide 21 is pivoted to the feeder case 17 to be able to swing horizontally.

The feeder rod 20 is formed of a slender sheet-shaped lower plate 22 whose right and left side edge portions are supported by the feeder rod guide 21 to be able to slide upward and downward, and intermediate plate 23 whose lower end portion is moveably coupled with an upper end portion of the lower plate 22, and an upper plate 25 whose lower end portion is coupled with the intermediate plate 23 through a push-down roller 24 projecting from an upper back surface of the intermediate plate 23. The push-down roller 24 is engaged with a lateral slot 26 formed at a lower end portion of the upper plate 25.

Further, in the middle portion of the upper plate 25, coil springs 27 are mounted on the coil receiving portions 28 of the feeder case 17 with the middle plate 23 and the lower plate 22 so as to forcibly move the upper plate 25 up and down.

Figure 3:
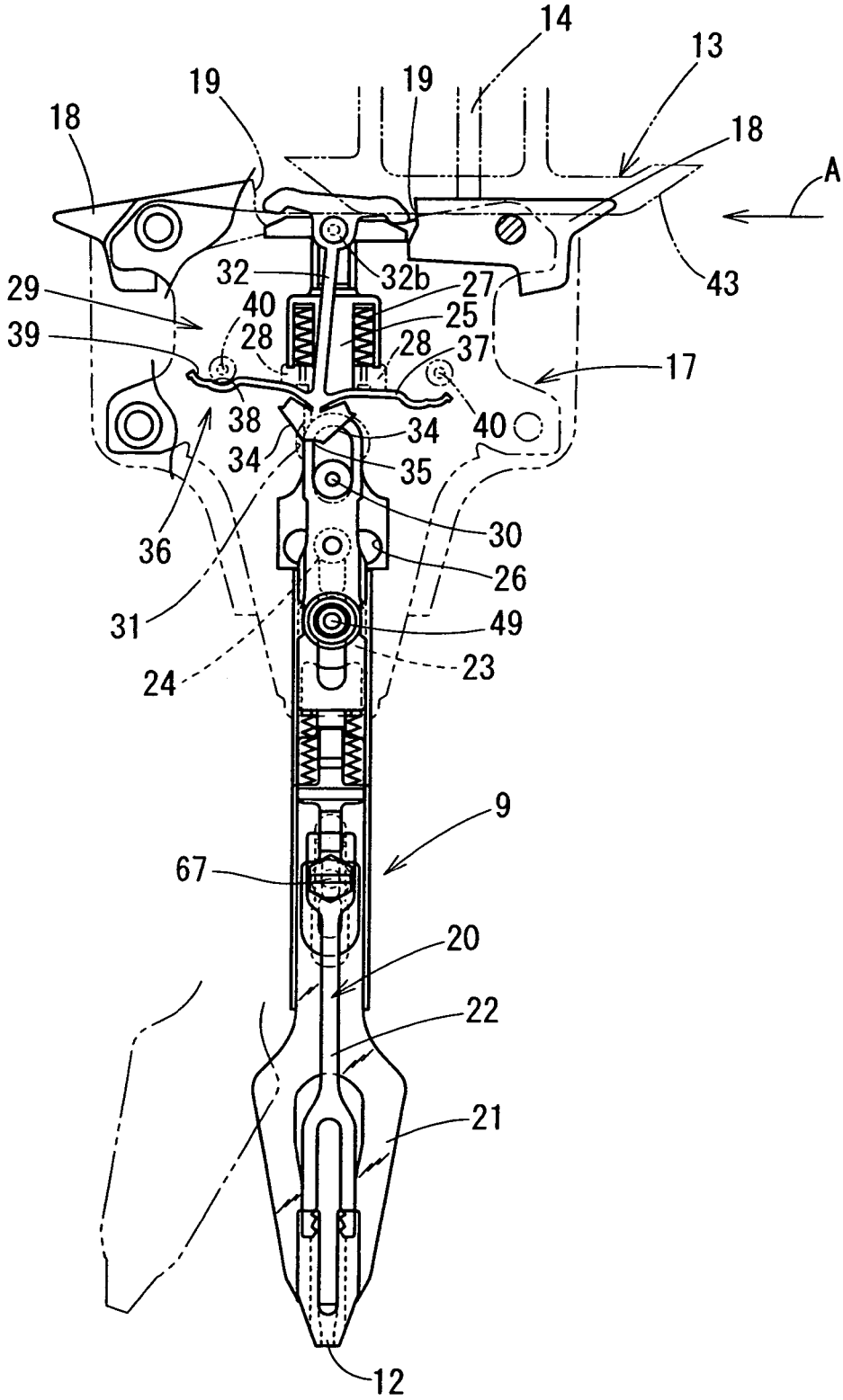
FIG. 3 is an explanatory view showing a mechanism of the yarn feeder of the present invention.
Figure 4:
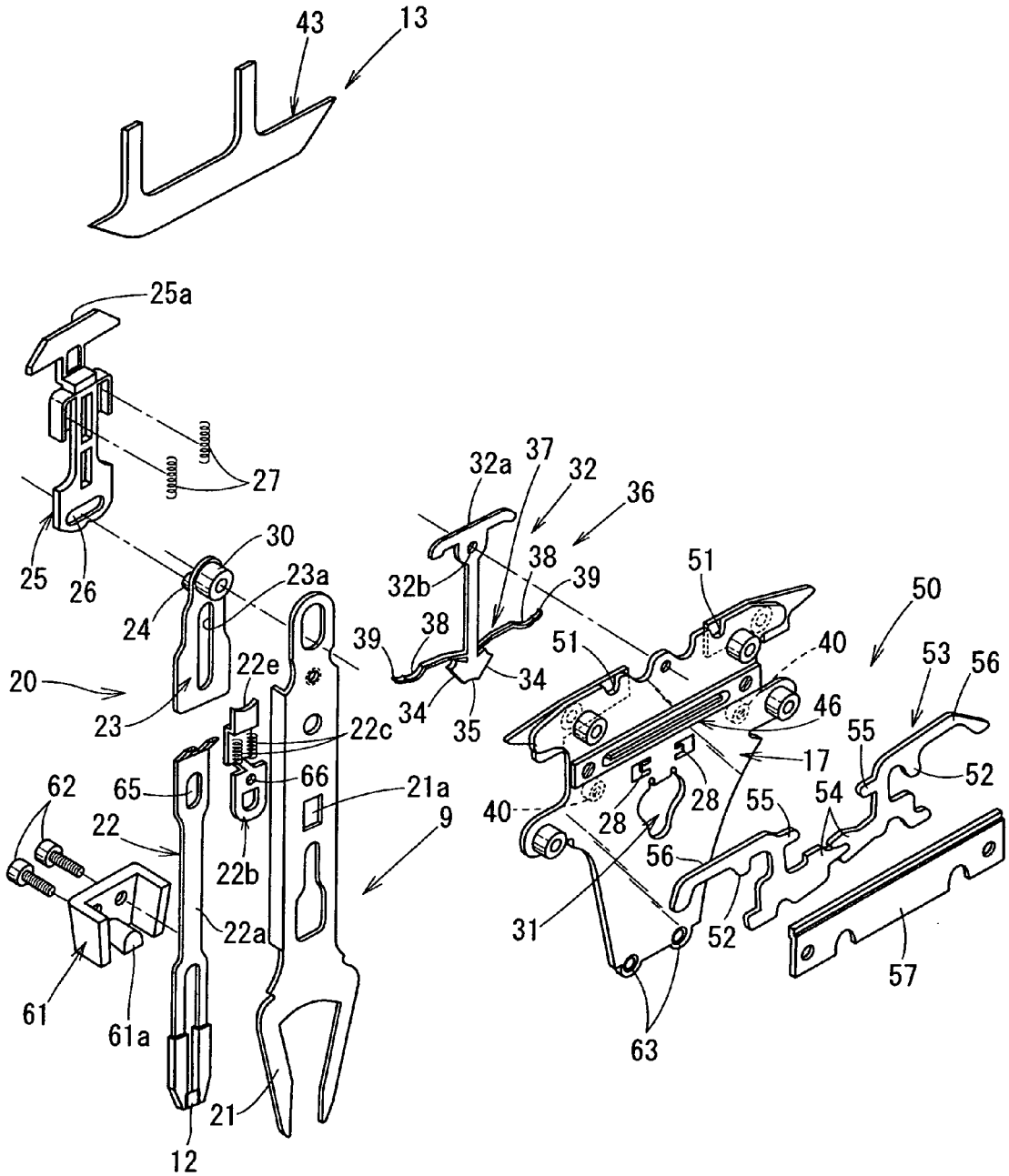
FIG. 4 is an exploded perspective view of the yarn feeder of the present invention.

As shown in FIGS. 3 and 4, the lower plate 22 includes a yarn feeding port forming member 22*a*, a spring storage member 22*b* interposed between the lower plate 22 and feeder rod guide 21 at a portion above the yarn feeding port forming member 22*a*, compression springs 22*c* stored in the spring storage member 22*b*, and a receiving portion 22*d* that is engaged with an engagement hole 21*a* of the feeder rod guide 21 and receives the lower end of the compression spring (urging portion) 22*c*. An abutment portion 22*e* that abuts against a regulation portion 46 (described later) is formed at the upper end of the spring storage member 22*b* such that the lower plate 22 is urged upward by the compression spring 22.

Figure 5:
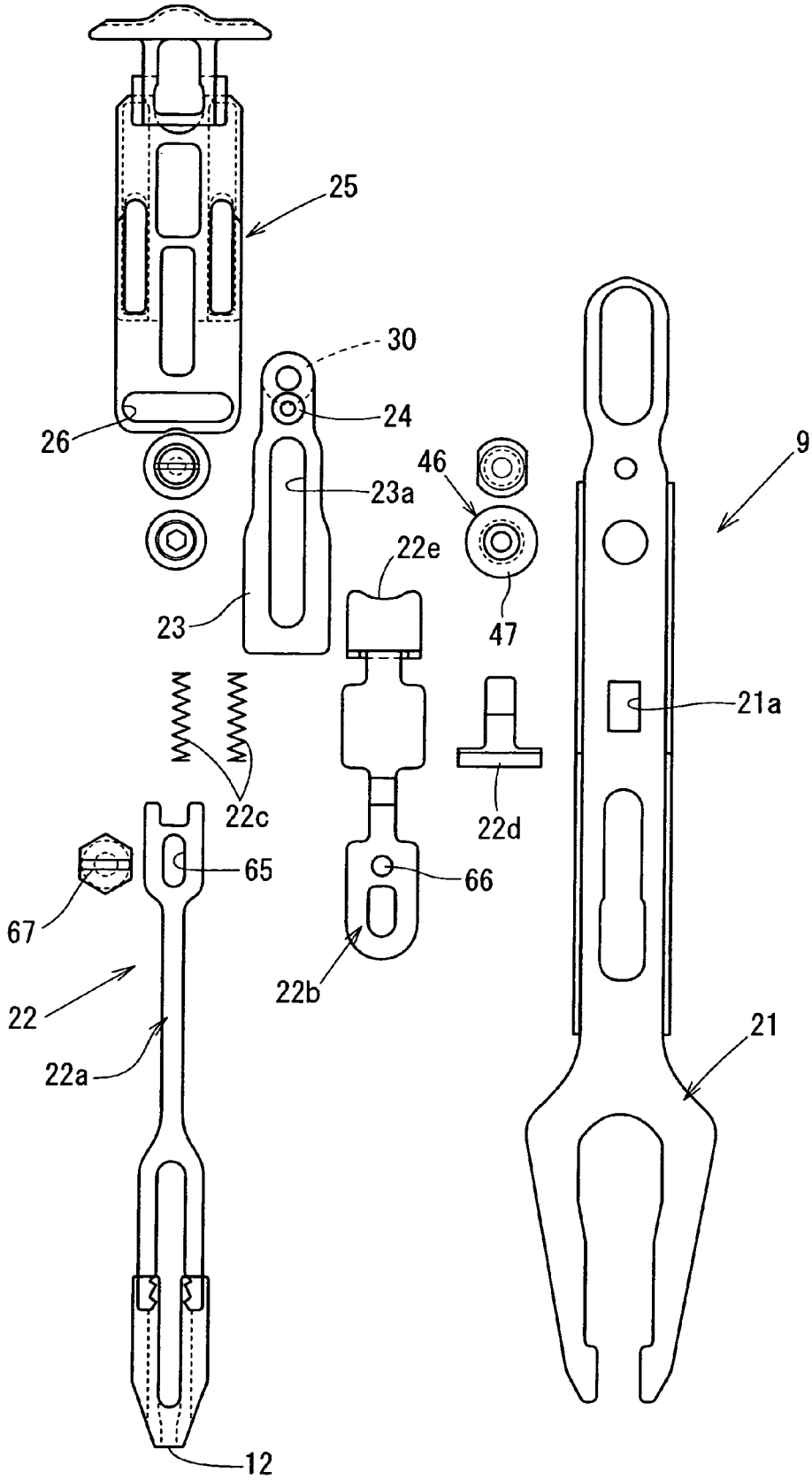
FIG. 5 is an exploded view of a feeder rod and regulation portion of the yarn feeder according to the present invention.
Figure 6:
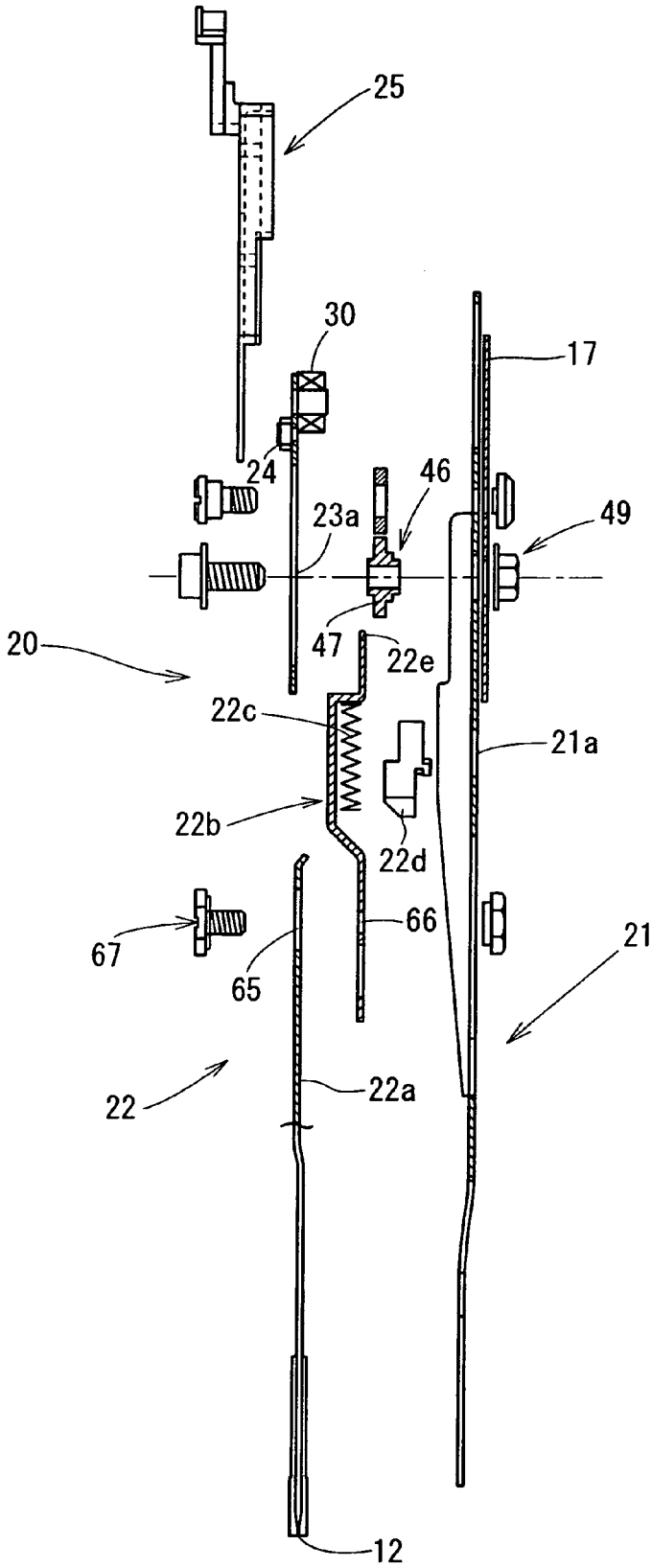
FIG. 6 is a partial vertical cross sectional view of exploded feeder rod and regulation element of the yarn feeder according to the present invention.
Figure 7:
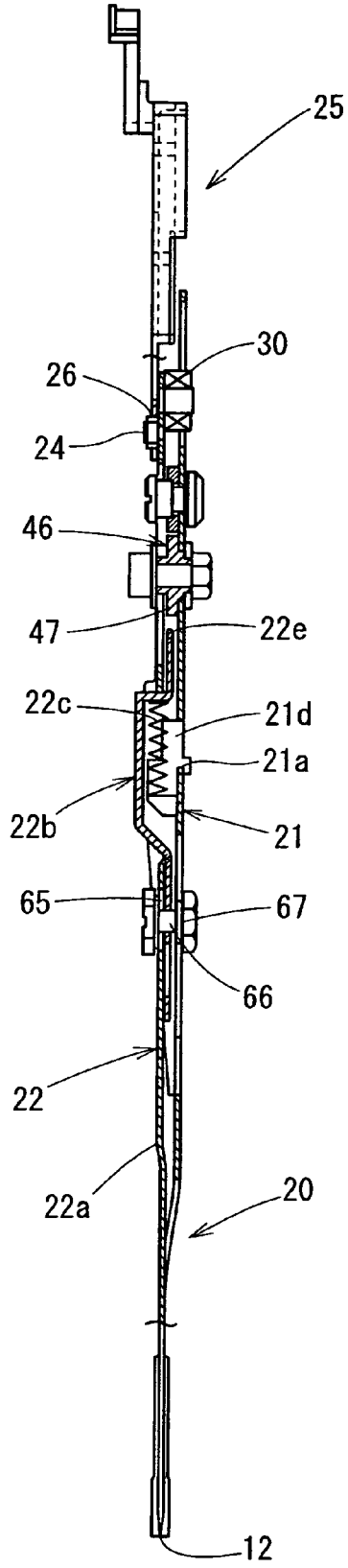
FIG. 7 is a vertical cross sectional view showing a part of the feeder rod and the regulation portion of the yarn feeder according to the present invention.

The regulation portion 46 that abuts against the abutment portion 22*e* is formed of a dice-like member 47 fixed to be tightened to the feeder case 17 together with the feeder rod guide 21 through a sliding slot 23*a* (see FIGS. 5, 6, and 7).

Further, when the slot 65 formed through the yarn feeding port forming member 22*a* of the lower plate 22 being associated with a hole 66 formed through the upper end of the spring storage member 22*b* by means of fixtures 67, for example, bolts and nuts, it is capable of adjusting a position of the lower plate 22 by loosening the fixture 67 to be adjustable in a altitude of the yarn feeding port 12 (referred to FIGS. 3 and 4).

Additionally, a switching roller 30 of a switching mechanism 29 for switching a position of the yarn feeding port 12 projects from a front surface of the intermediate plate 23 at an upper end portion thereof.

The switching mechanism 29 includes the switching roller 30, a regulation hole 31 formed through the feeder case 17 for regulating a swing motion of the switching roller 30, and a selection lever 32 disposed on a back surface side of the regulation hole 31.

As shown in FIGS. 3 and 4, the regulation hole 31 is formed in substantially a trifoliate shape having spaces with which the switching roller 30 is engaged at the center, upper left and upper right portions thereof.

The selection lever 32 that sets an upward moving direction of the switching roller 30 confronting the regulation hole 31 is formed in substantially a T-shape with its upper end portion 32*a* formed in a gentle V-shape. The selection lever 32 is pivoted to the feeder case 17 at a pivot portion 32*b* at the center, which hangs down from a center of the upper end portion 32*a* and terminates in an arrow shape having oblique surfaces 34 and 34 on the right and left sides thereof for directing the upward moving direction of the switching roller 30. The intermediate portion between the oblique surfaces 34 and 34 has a roller receiving portion 35 that receives the switching roller 30 in a neutral position.

A holding means 36 for holding the switched positions of the selection lever 32 is disposed at an upper portion of an arrow-shaped portion formed of the two oblique surfaces 34 and 34 and the roller receiving portion 35.

The holding means 36 is arranged such that mustache-like elastic portions 37 are extended in both horizontal directions from an upper portion of the arrow-like portion, and gripping portions 38 and 39 are formed by bending portions near extreme ends of the elastic portions 37. Further engaging projections 40 are formed on a back surface of the feeder case 17 such that any one of them is engaged with any one of the gripping portions 38 and 39 when the selection lever 32 is turned to any one of the right or left position. This makes it possible to hold the switching position of the selection lever 32.

The neutral position holding mechanism 50 that holds the yarn feeding port 12 at the low neutral position adjacent to the knitting needle 5 while keeping the selection lever 32 in an upright state at the standby position is, as shown in FIG. 4, composed of pivot portions 51 and 51 each formed through the upper end portion of the feeder case 17 and a pair of links 53 having rotating portions 52 and 52 pivoted to the pivot portions 51 and 51 so as to be enabled to swing.

The pair of links 53 includes engagement portions 54 each having the extreme end portion engaged with each other at the center of the feeder case 17 in a horizontal direction. Protrusions 55 for operating the selection lever 32 into the neutral position by pushing up the upper end portion 32*a* of the selection lever 32 from the lower side are formed at the respective side surfaces that face with each other. Operation pieces 56 each extending to the left and the right from the rotating portions 52 are formed at the upper portion of the respective links 53.

The operation pieces 56 swung by the entraining pins 14 are formed to extend to the left and the right from the rotating portions 52, and have the upper surface oblique to be lower as it becomes closer to the engagement portion 54, and the outer end oblique downward. A reference numeral 57 denotes a plate of preventing dropout of the link 53. In this manner, the pair of links 53 simultaneously push up the upper end portion 32*a* of the selection lever 32 with the left and right protrusions 55 such that the selection lever 32 is reliably brought into the neutral position.

The push-down member 13 that pushes down the feeder rod 20 is composed of a coupling plate 42 having one end coupled with the entraining pin 14 at an intermediate height position thereof, and a cam plate 43 having upper end portion coupled with another end of the coupling plate 42, whereby the cam plate 43 can be swung back and forth about a swing pivot pin 44 interlocking with up and down movement of the entraining pin 14.

The entraining pin 14 is disposed on the middle of the cam plate 43 aside of the knitting yarn guide rail 11.

A reference numeral 46 shown in FIG. 4 denotes a brake unit formed of a magnet attracted to the knitting yarn guide rail. Since the yarn feeder 9 is reduced in size and weight, the yarn feeder 9 can be stopped at an accurate position even by a light sliding friction generated by an attracting force of the magnet.

Accordingly, unlike the generally employed yarn feeder, the present invention never causes the problem of unstable on stop position due to a large inertia force applied thereon, even if the yarn feeder interlocking with entraining device is stopped in a place, which fails to allow the yarn feeder to stop at the desired position. It is unnecessary to provide a special brake unit for stopping the yarn feeder at the desired position against the large inertia force.

Next, a description of operations performed in production of a knitted fabric with an intarsia pattern by the yarn feeding machine according to the present invention will be given.

In the weft knitting machine employed herein, two pairs of cam units are formed while having each phase varied in the movement direction of the carriage. An exemplary knitting operation around the boundary between the left and right knitting regions will be described, taking the case where the preceding cam unit forms the right knitting region and the subsequent cam unit forms the left knitting region by means of the needle-jumping-over knitting operation respectively when the carriage is driven from right to left as shown by arrow A in the drawing.

As the carriages 6 are caused to travel on the needle beds 3 from right to left (direction shown by the arrow A in FIGS. 3 and 8) by the belt drive device in response to a signal output from the controller, the knitting needles 5 disposed in parallel with each other on the needle beds 3 are advanced and retreated by the knitting cams 7.

When the carriages 6 travel, in a portion where no knitting is executed, a solenoid is actuated responding to an output signal of pattern knitting operation so that the output shaft of the solenoid is projected downward and the entraining pin 14 of the entraining device 10 is moved upward against tension of a spring 16 through the transmission rod 15 thereafter.

As the entraining pin 14 is moved upward, the cam plate 43 of the push-down member 13 is lifted up about a swing pivot pin 44 (refer to the cam plate 43 at the right side in FIG. 2).

At a portion where knitting is performed, the solenoid is actuated in response to the signal output from the controller in front of a position where the carriage 6 confronts a predetermined yarn feeder 9 for supplying yarn to the knitting needles 5, and when the output shaft of the solenoid is receded upward, the entraining pin 14 moved upward is pushed downward by the tension of the spring 16. In association with this pushed-down operation of the entraining pin 14, the cam plate 43 of the push-down member 13 is swung toward the yarn feeder 9 about the swing pivot pin 44 through the coupling plate 42 (refer to the cam plate 43 at the left side of FIG. 2).

Figure 8:
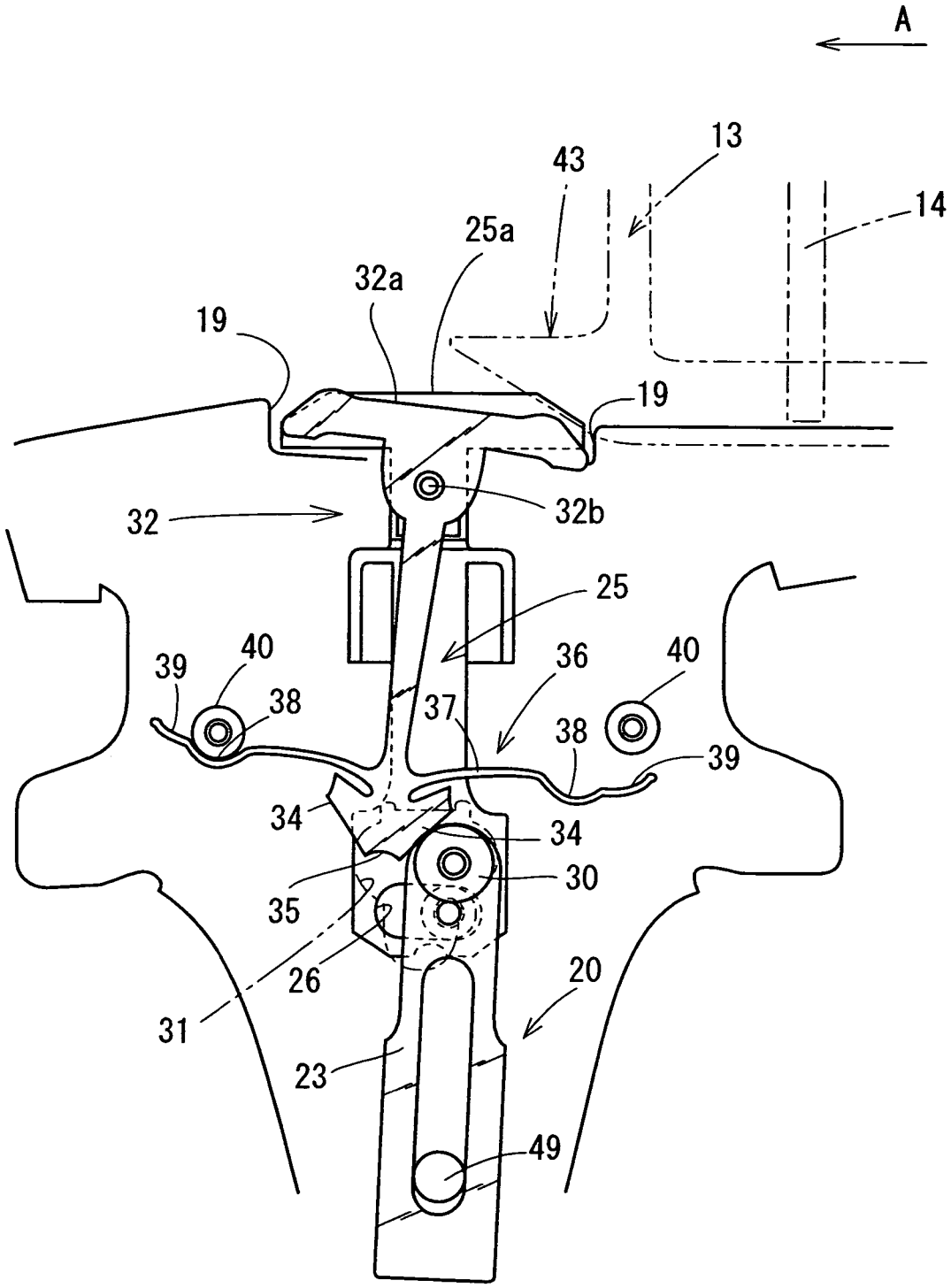
FIG. 8 is an explanatory view of a selection lever of the yarn feeder according to the present invention.
Figure 9:
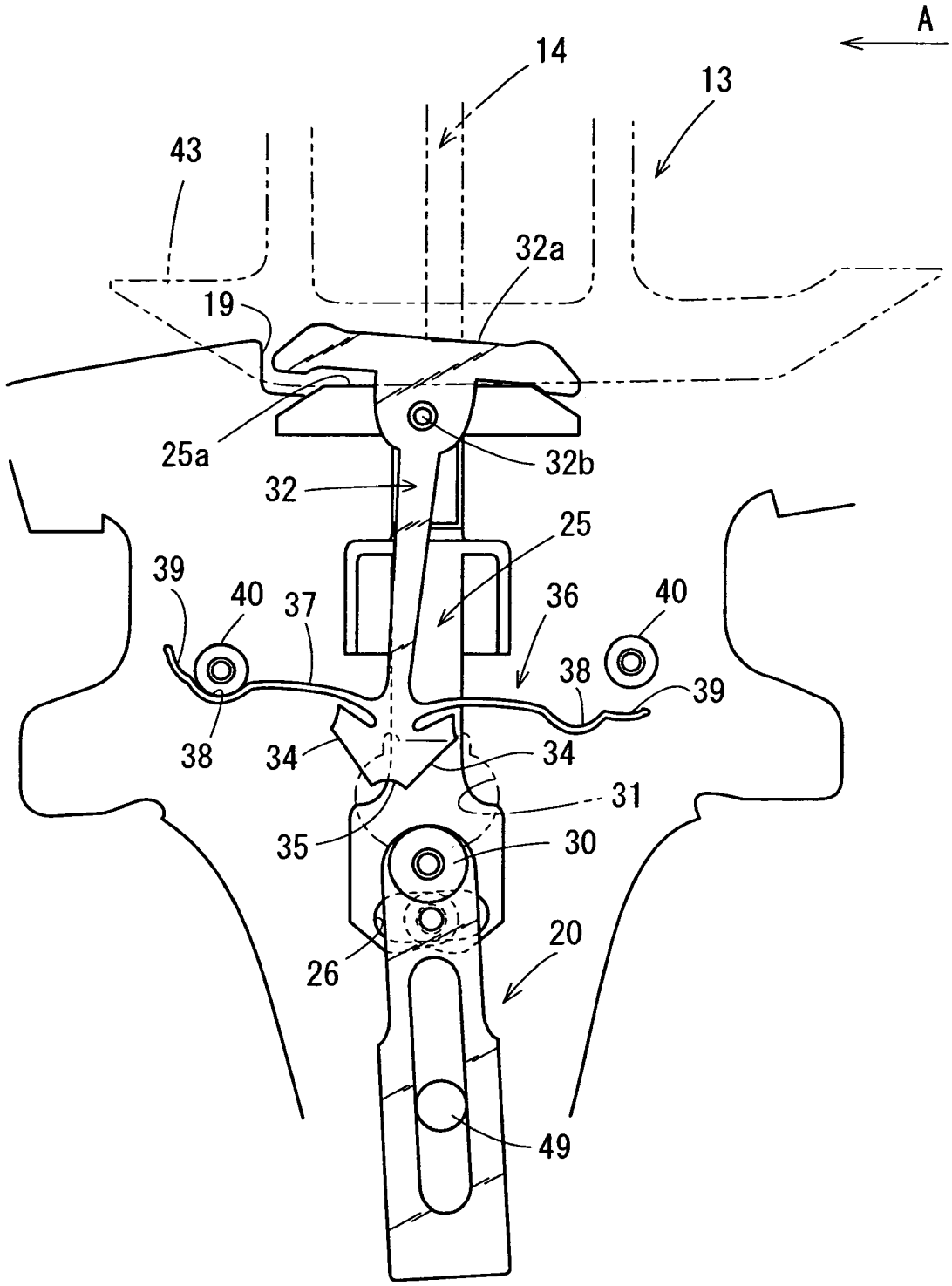
FIG. 9 is an explanatory view of the selection lever of the yarn feeder according to the present invention.
Figure 11:
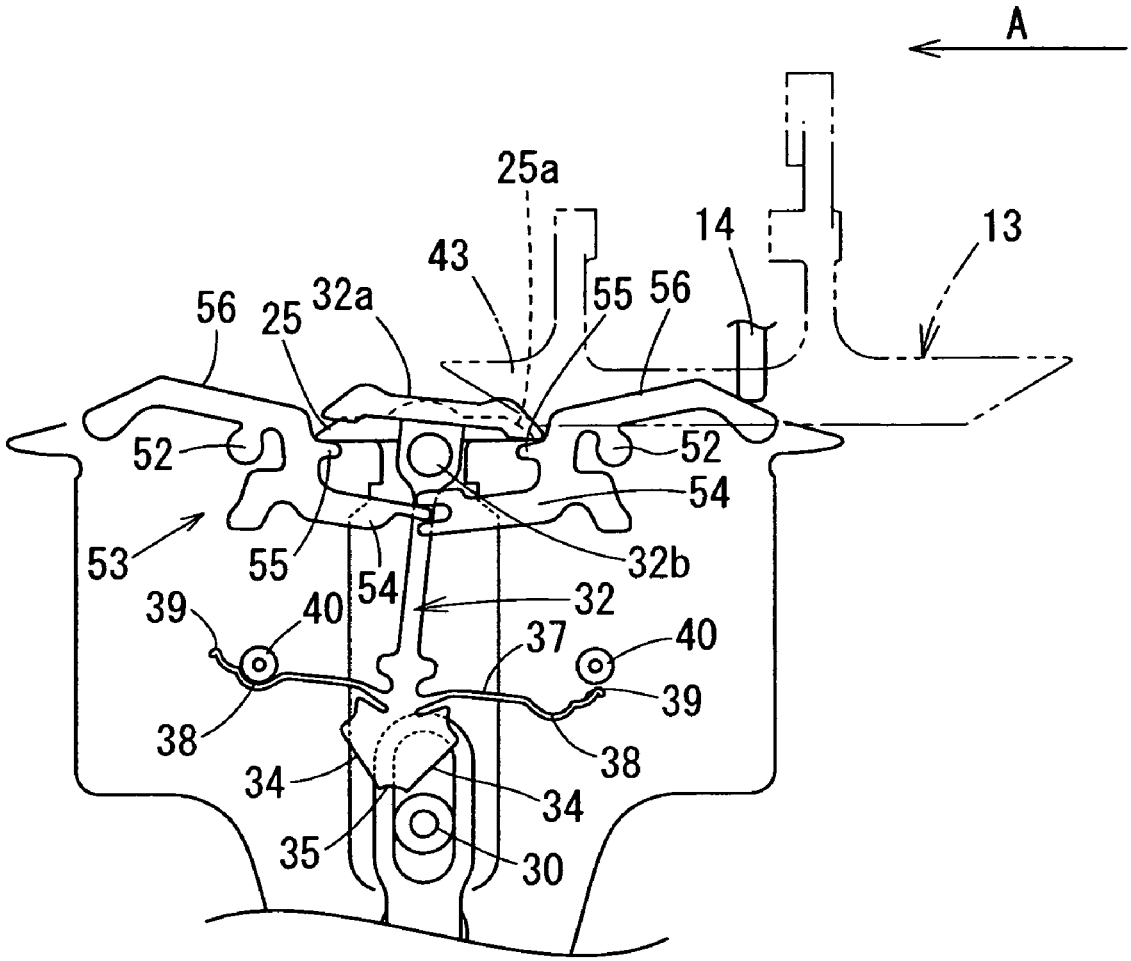
FIG. 11 is an explanatory view showing an operation of a link portion that operates the selector lever of the yarn feeder according to the present invention.
Figure 12:
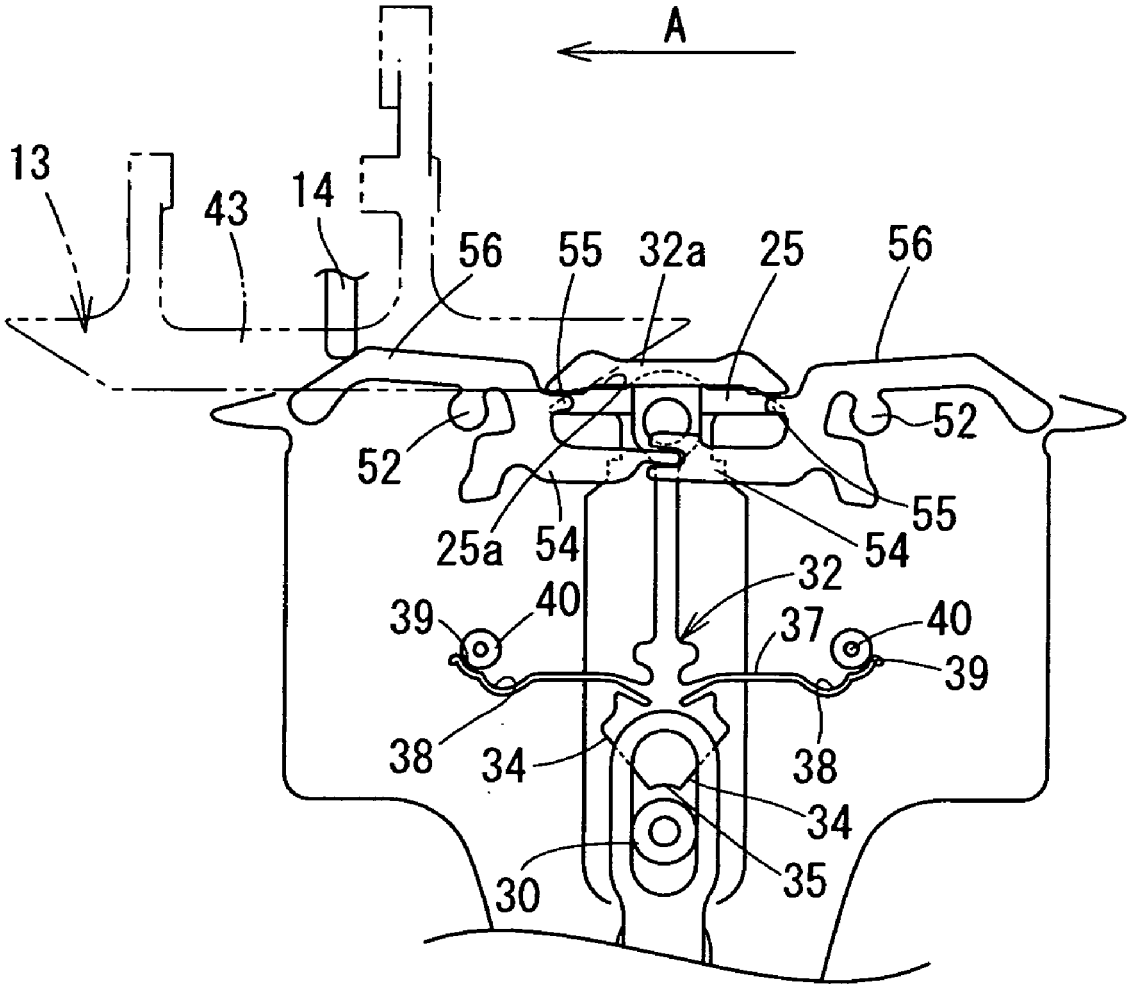
FIG. 12 is an explanatory view showing an operation of the link portion that operates the selection lever of the yarn feeder according to the present invention.

As the carriage 6 slides, the cam plate 43 pushes down the upper end portion (push-down portion) 25*a* of the upper plate 25 against a force caused by contraction of a coil spring 27, the switching roller 30 borne in the regulation hole 31 being guided downward to be centered in the lower portion of the regulation hole 31 and put on the descended position as shown in FIG. 9 and FIG. 12 from the state as shown in FIG. 8 and FIG. 11.

As the switching roller 30 through guidance of the regulation hole 31 descends to the middle of the lower portion in the regulation hole 30, the feeder rod guide 21 stands upright at the center of the feeder case 17 while projecting the yarn feeding port 12 of the feeder rod 20 downward from a lower end of the feeder rod guide 21, and the yarn feeding port 12 is located at a yarn feed position adjacent to the knitting needles 5 on a needle bed 3.

Figure 10:
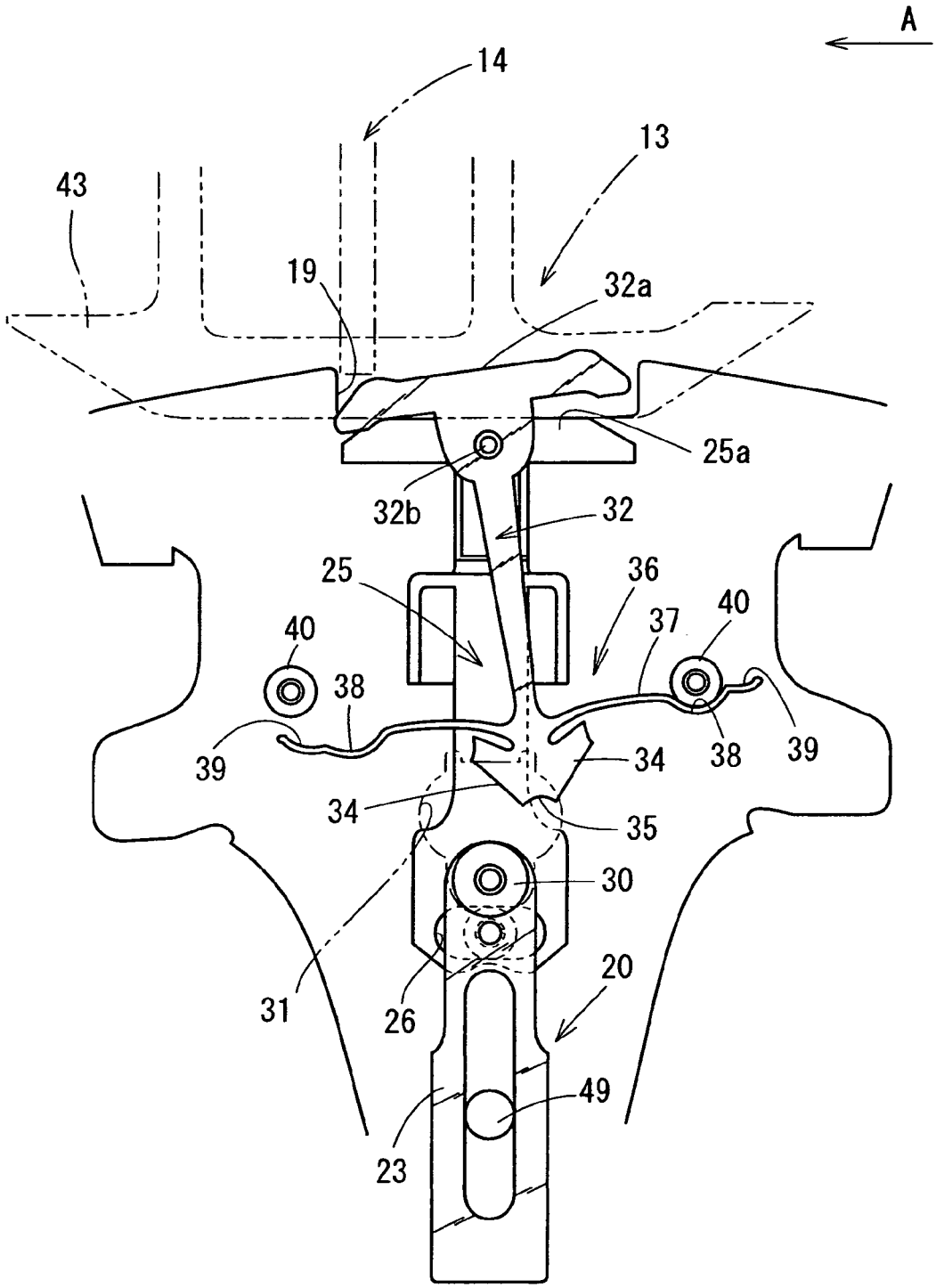
FIG. 10 is an explanatory view of the selection lever of the yarn feeder according to the present invention.

As the carriage 6 goes further away in the left side direction and subsequently the entraining pin 14 presses a projecting upper end portion 32*a* at a lower part (left side) of the selection lever 32, the selection lever 32 is swung counterclockwise about the pivot portion 32*b* acting as a center of rotation as shown in FIG. 10. The position of the selection lever 32 is held because the left gripping portion 38, which forms a holding member 36, of the elastic portion 37 of the selection lever 32 is disengaged from the engaging projection 40, and because the right gripping portion 39 is engaged with engaging projection 41.

Thereafter, when the entraining pin 14 abuts against the engaging portion 19 of the swinging piece 18 located downstream of an advancing direction of the selection lever 32, the yarn feeder 9 is brought by the carriage 6, and yarn is fed to the knitting needles 5 from the yarn feeding port 12 of the yarn feeder 9. In this manner, the knitting operation is performed with the yarn fed from the yarn feeder 9 in the right knitting region.

When knitting operation of the determined knitting region having been finished and reached to the standby position outside the knitting region, the solenoid is energized in response to a signal output from the controller, in which the output shaft of the solenoid projects downward, the entraining pin 14 expanded downward being pushed up against the force caused by stretch of the spring 16.

As the entraining pin 14 is moved upward, the cam plate 43 of the push-down member 13 is swung to be lifted up about the swing pivot pin 44 in the state shown by the right side of FIG. 2.

When the entraining pin 14 having been moved upward and subsequently disengaged from the engaging portion 19 of the swinging piece 18 located downstream of an advancing direction of the carriage 6, the interlocked yarn feeder 9 is released. In addition, since the cam plate 43 is lifted up and swung, the feeder rod 20 that has been pushed down is pushed upward by the force caused by extension of the coil spring 27 into a position where the yarn feeding port 12 at a lower end thereof does not interfere with the yarn feeding port 12 of another yarn feeder 9, knitting needles 5, sinkers or the like.

At this time, the position of the yarn feeder 9 in the standby state is defined by the selection lever 32.

When the yarn feeding port 12 is brought into the swinging position to the left and the right at the standby position, the gate arm (slide drive mechanism) 8 drives the carriage 6 leftward as shown by the arrow A in the drawing. When the cam plate 43 pushes down the upper end 25*a* of the upper plate 25, the feeder rod 20 is moved downward. At this time, the switching operation with respect to the selection lever 32 may be freely done (refer to FIG. 10).

Then the entraining pin 14 pushes the right operation member 56 in the state where the cam plate 43 keeps pushing the upper plate 25, and further the right side of the upper end 32*a* of the selection lever 32. Thereafter, the left side of the upper end 32*a* of the selection lever 32 is pushed to engage the engaging portion 19 of the left swinging piece 18 with the entraining pin 14 to bring the yarn feeder 9 into a yarn feeding state. At the yarn feeding position, the upper plate 25 has been kept pushed by the cam plate 43.

When the entraining pin 14 is disengaged from the cam plate 43 for releasing the entraining state of the yarn feeder 9, the yarn feeding is stopped by the brake unit 46.

In this state, as the selection lever 32 is kept oblique counterclockwise, the feeder rod 20 moves upward to swing to the right as shown in FIG. 10.

Meanwhile, when the feeder rod 20 is required to be brought into the neutral position, the entraining pin 14 is disengaged from the cam plate 43 so as to allow passage of the carriage 6. At this time, the feeder rod 20 is kept swung to the right.

Assuming that the entraining pin 14 and the cam plate 43 are activated to push the right operation member 56 with the entraining pin 14 such that the selection lever 32 is brought into the neutral position, and the engagement between the entraining pin 14 and the cam plate 43 is released when the carriage 6 turns reversely to reach the yarn feeder 9, the yarn feeding port 12 is held at the low neutral position as the resultant position is held by the gripping portions 39, and accordingly, the feeder rod 20 that moves upward is received by the roller receiving portion 35 in the state where the selection roller 30 at the upper end portion is in the neutral position.

In the aforementioned embodiment, the pair of links 53 coupled with each other are employed. However, the invention is not limited to the structure as described above. It may be structured to push up the upper end 32*a* of the selection lever 32 from the lower side.

In the embodiment, the yarn feeder 9 is structured to swing at the standby position for knitting the fabric with the intarsia pattern. However, when the yarn feeder is used for the normal knitting, that is, as the yarn feeder that does not swing, the swing regulation unit designated by the reference numeral 61 in FIG. 4 can be employed.

The upper plate 25 is pushed down to the position that is not influenced by the cam plate 43, that is, the feeding position, and the protrusion 61*a* of the swing regulation unit 61 is inserted into the lower end of the slide slot 23*a* formed through the intermediate plate 23. When the swing regulation unit 61 is fit with the female screw 63 in the feeder case 17 with the tightening unit 62, the yarn feeding rod guide 21 is constrained from its sides to regulate the swinging motion to form the yarn feeder for the normal knitting.

The invention claimed is:

1. A yarn feeder of a yarn feeding device used for a weft knitting machine, the yarn feeding device comprising:

a plurality of yarn feeders which are engaged with and to be slide on knitting yarn guide rails arranged over a needle bed;

an entraining means for entraining selectively any one of the yarn feeders;

a position switch mechanism for switching over the swing of a yarn feeding port provided at a lower end of a feeder rod between a yarn feeding position and a standby position interlocking with the operation of the entraining means, wherein the position switch mechanism comprises a selection lever which is substantially formed in a T-like shape and pivoted to be enabled to swing between the yarn feeding position and the standby position, the selection lever being formed of two oblique surfaces each setting a swinging direction of the feeder rod and a receiving portion at an intermediate portion between the oblique surfaces for gripping the feeder rod at a neutral position in an upright position, and;

a position holding mechanism for keeping the yarn feeding port of the yarn feeder selected by the entraining means in any one of the yarn feeding position, the standby position and the neutral position corresponding to the selected yarn feeder, the position holding mechanism having an operation device composed of a pair of links to be activated in association with the entraining means, wherein when the operation device being activated, portions adjacent to the middle of the selection lever are pushed up and swung by the pair of links respectively so that the receiving portion of the selection lever holds the upper end of the feeding rod upright state in the neutral position with making the upper end of the feeding rod confronted with the receiving portion of the selection lever.

2. A yarn feeder of a yarn feeding device for a weft knitting machine according to claim 1, characterized in that the feeder rod forms a holding member that elastically holds a position set by one of the oblique surfaces and the receiving portion on the selection lever.

* * * * *